US009591391B2

(12) United States Patent
Liu et al.

(10) Patent No.: US 9,591,391 B2
(45) Date of Patent: Mar. 7, 2017

(54) VIBRATION SPEAKER

(71) Applicants: Lin Liu, Shenzhen (CN); Jie He, Shenzhen (CN); Hongxing Wang, Shenzhen (CN); Rongguan Zhou, Shenzhen (CN); Yun Tang, Shenzhen (CN); Gang Li, Shenzhen (CN); Yuanxiao Peng, Shenzhen (CN)

(72) Inventors: Lin Liu, Shenzhen (CN); Jie He, Shenzhen (CN); Hongxing Wang, Shenzhen (CN); Rongguan Zhou, Shenzhen (CN); Yun Tang, Shenzhen (CN); Gang Li, Shenzhen (CN); Yuanxiao Peng, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/742,833

(22) Filed: Jun. 18, 2015

(65) Prior Publication Data

US 2015/0289043 A1 Oct. 8, 2015

Related U.S. Application Data

(62) Division of application No. 13/737,948, filed on Jan. 10, 2013, now Pat. No. 9,148,716.

(51) Int. Cl.

| | |
|---|---|
| ***H04R 1/02*** | (2006.01) |
| ***H04R 7/04*** | (2006.01) |
| *H04R 17/00* | (2006.01) |

(52) U.S. Cl.
CPC ..... *H04R 1/028* (2013.01); *H04R 1/021* (2013.01); *H04R 7/045* (2013.01); *H04R 17/00* (2013.01); *H04R 2400/03* (2013.01); *H04R 2440/05* (2013.01); *H04R 2499/11* (2013.01); *H04R 2499/15* (2013.01)

(58) Field of Classification Search
CPC ..... H04R 1/028; H04R 1/021; H04R 7/045
See application file for complete search history.

(56) References Cited

U.S. PATENT DOCUMENTS

2008/0132313 A1* 6/2008 Rasmussen ..... G07F 17/32 463/16
2010/0067726 A1* 3/2010 Suzuki ..... G06F 1/1605 381/333

* cited by examiner

*Primary Examiner* — Simon King
(74) *Attorney, Agent, or Firm* — Na Xu; IPro, PLLC

(57) ABSTRACT

A vibration speaker is disclosed. The vibration speaker includes: a display screen including a first surface and a second surface opposite to the first surface; a vibrator disposed below the display screen with vibration direction perpendicular to the display screen; a cover including a lower cover and an upper cover assembled with the lower cover for forming a receiving space to receive the display screen and the vibrator; an elastic member comprising an inner end attached to the display screen, an outer end disposed between the lower cover and the upper cover, and a connecting part disposed between the inner end and the outer end and concaved towards the lower cover; wherein the display screen is actuated to vibrate and generate sound by the vibration of the vibrator.

14 Claims, 6 Drawing Sheets

VIBRATION SPEAKER

CROSS REFERENCE TO RELATED APPLICATION

This application is a divisional application of U.S. Ser. No. 13/737,948 filed on Jan. 10, 2013. The contents of these applications are incorporated by this reference.

FIELD OF THE INVENTION

The present disclosure relates to a speaker, and more particularly to a vibration speaker for generating sound by a display screen.

DESCRIPTION OF RELATED ART

With the rapid development of the intelligent portable device such as cellular phones, people request for more and more functions such as high quality music and vibration function. An electromagnetism speaker generating both music and vibration is commonly used in cellular phones.

A related electromagnetism speaker comprises a frame, a vibrating unit received in the frame and including a diaphragm and a voice coil attached to the diaphragm, a magnetic circuit unit retained in the frame and driving the voice coil and the diaphragm to vibrate for generating sound. The related electromagnetism speaker further includes an elastic member to sustain the magnetic circuit unit to vibrate in the frame. However, the above mentioned speaker has a complicated inner structure.

Therefore, it is necessary to provide a new speaker for solving the problem mentioned above.

DETAILED DESCRIPTION OF THE EMBODIMENTS

Reference will now be made to describe the exemplary embodiments of the present invention in detail.

Figure 1:
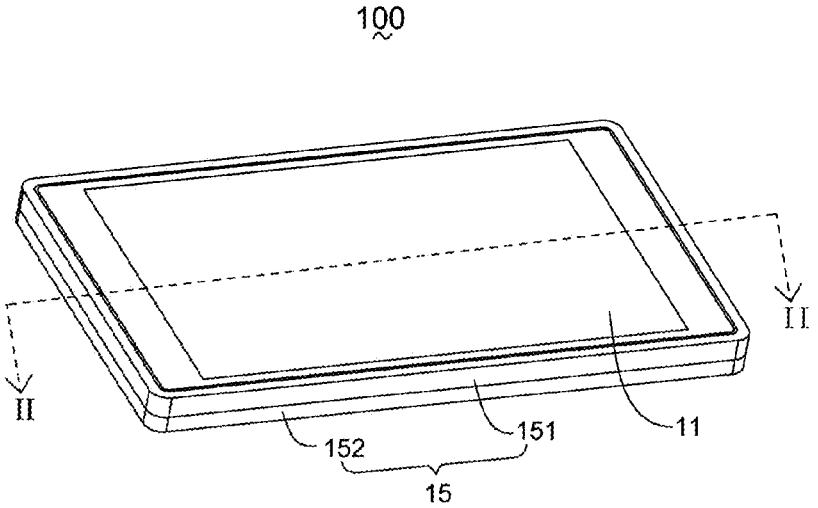
FIG. 1 is an isometric assembled view of a screen speaker according to a first embodiment of the present disclosure.
Figure 2:
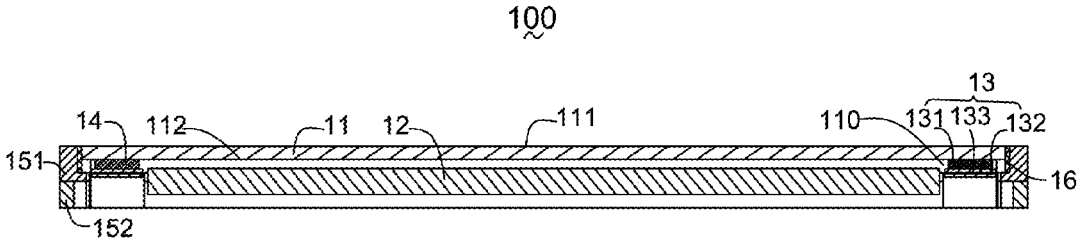
FIG. 2 is a sectional view along line II-II shown in FIG. 1.
Figure 3:
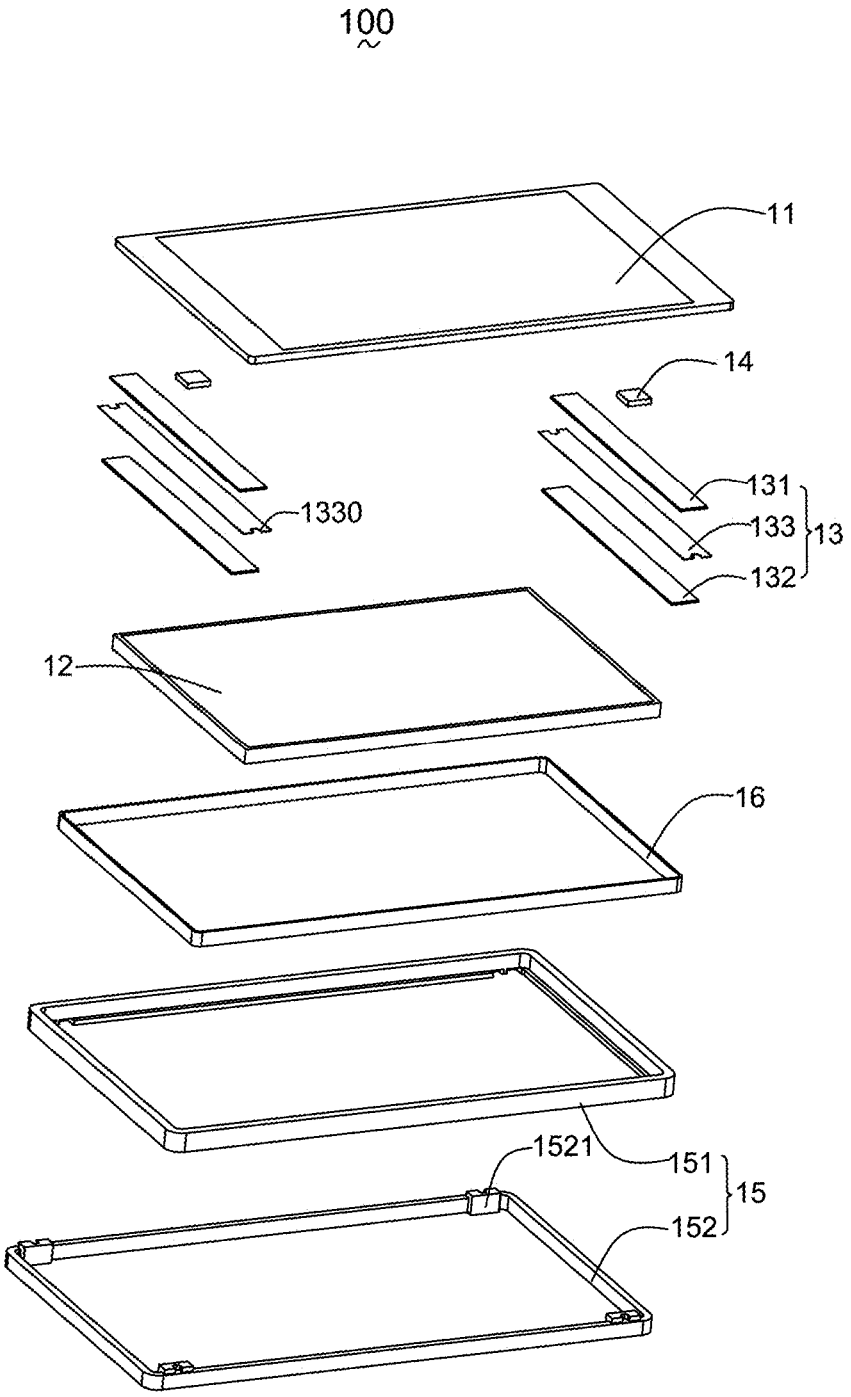
FIG. 3 is an exploded view of the screen speaker shown in FIG. 1.

Referring to FIGS. 1-3, a vibration speaker 100 according to a first embodiment of the present disclosure comprises a first panel 11, a second panel 12, a vibrator 13 disposed below the first panel 11 and driving the first panel 11 to vibrate and generate sound, a cover 15 forming a receiving space to receive the first panel 11, the second panel 12 and the vibrator 13, and a sealing ring 16 disposed between the first panel 11 and the cover 15. The second panel 12 is located below the first panel 11 and forming a gap therebetween. The first panel 11 is provided with a first surface 111 disposed outside and a second surface 112 opposite to the first surface 111. The sealing ring 16 forms a chamber 110 cooperating with the first panel 11, the second panel 12 and the cover 15 for receiving the vibrator 15.

The vibrator 13 is attached to the second surface 112 of the first panel 11 by a block 14. The block 14 is made from silica and includes adhesive tapes at two faces thereof, which is used for connecting the vibrator 13 to the first panel 11 and protecting the first panel 11 from touching the second panel 12 while the first panel 11 is activated by the vibrator 13 to vibrate.

The vibrator 13 is a piezoelectric vibrator and includes a base plate 133, a first piezoelectric plate 131 and a second piezoelectric plate 132 respectively attached to two surfaces of the base plate 133. The base plate 133 has a configuration of rectangle and includes a pair of long sides and a pair of short sides. A position part 1330 is formed at the short side of the base plate 133.

The cover 15 includes an upper cover 151 surrounding around the first panel 11 and a lower cover 152 engaged with the upper cover 151. A plurality of protruding portions 1521 is formed on an inner wall of the lower cover 152 and engaging with the position parts 1330 of the vibrator 13. The vibrator 13 is supported and retained by the lower cover 152.

In this embodiment, there are two vibrators 12 symmetrically disposed at two ends of the first panel 11 and parallel to each other. The two vibrators 12 vibrate in a same frequency and along a direction perpendicular to the first panel 11. When the vibrators 2 are provided with signals, the vibrators 2 vibrate and drive the first panel 11 to vibrate and generate sound.

Figure 4:
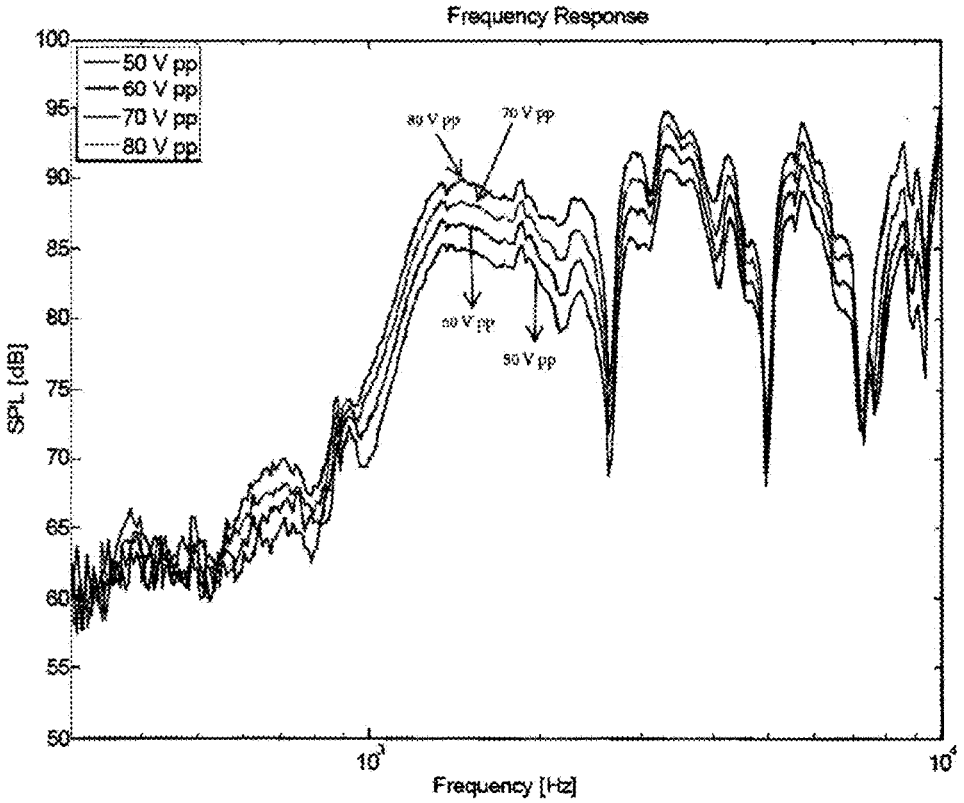
FIG. 4 is a frequency response graph of the screen speaker shown in FIG. 1.
Figure 5:
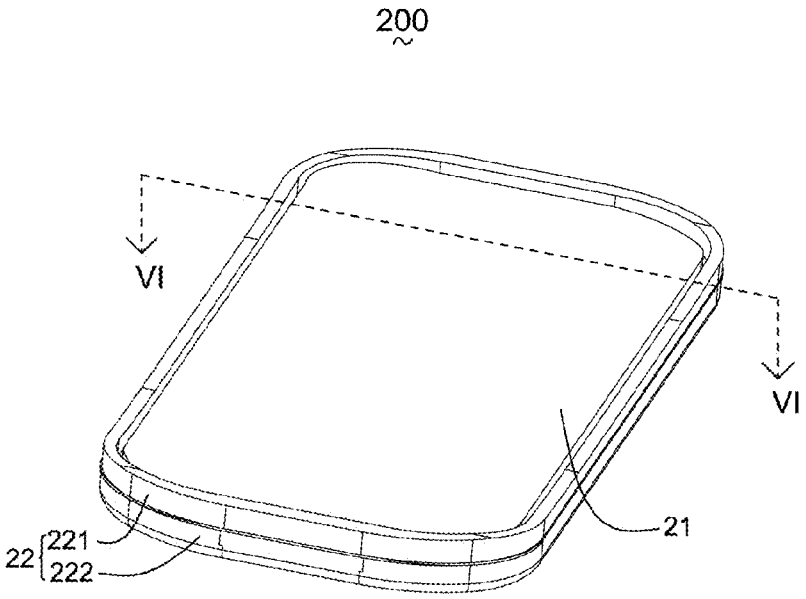
FIG. 5 is an isometric assembled view of a screen speaker according to a second embodiment of the present disclosure.
Figure 6:
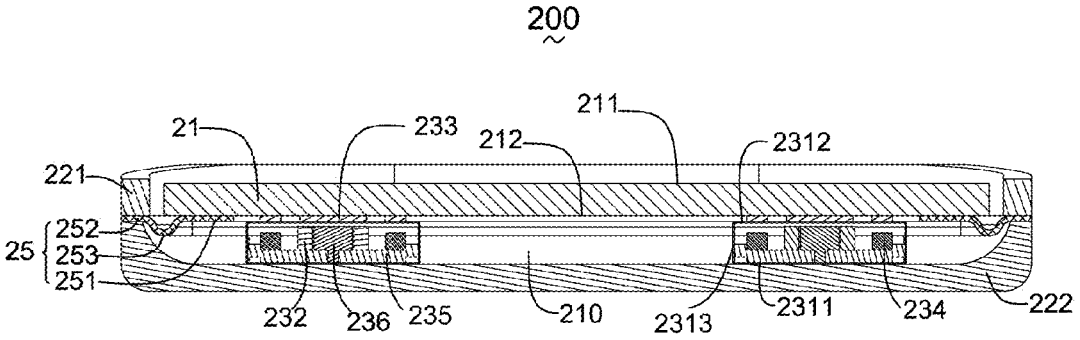
FIG. 6 is a sectional view along line VI-VI shown in FIG. 5.
Figure 7:
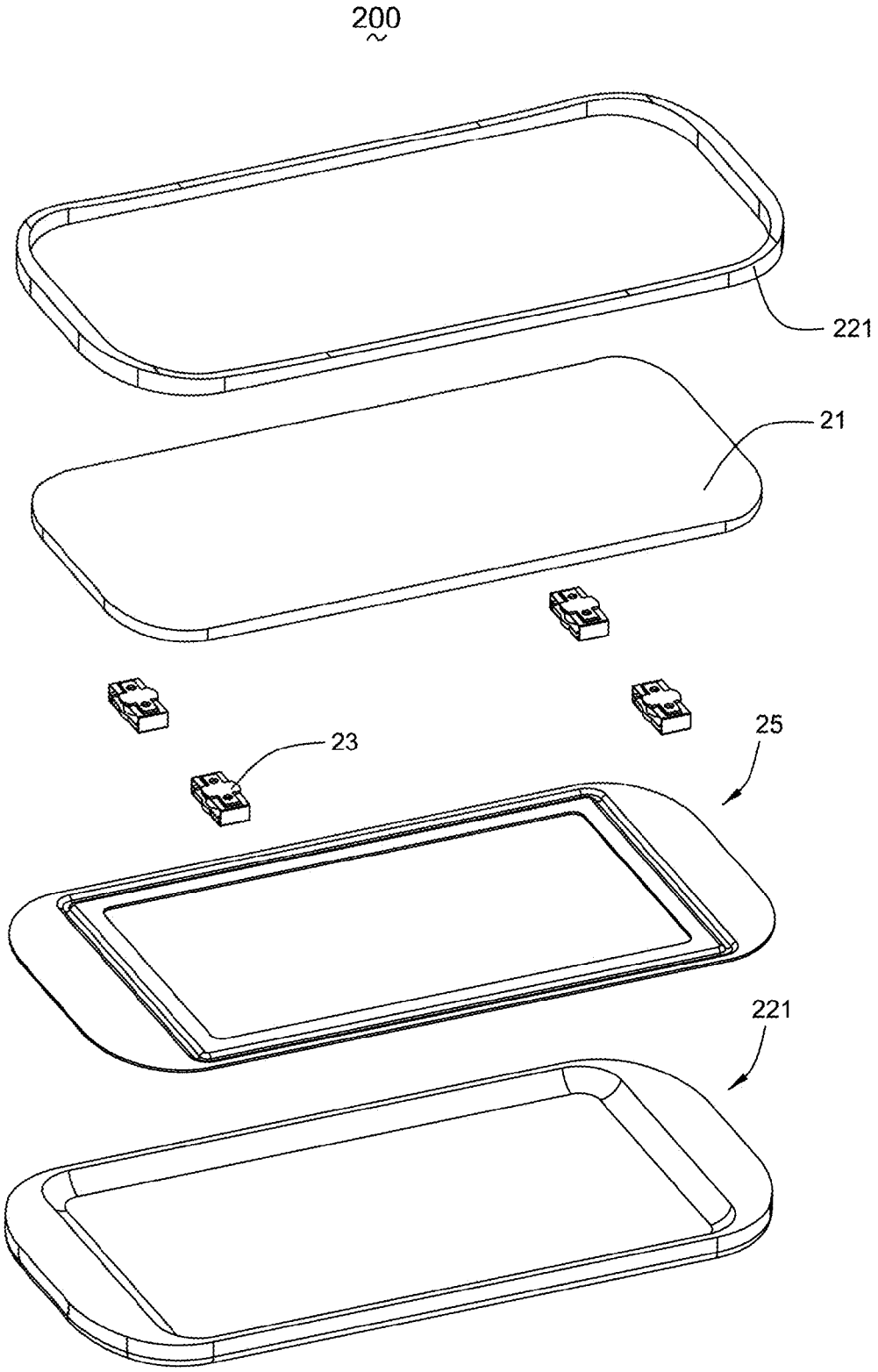
FIG. 7 is a partially exploded view of the screen speaker shown in FIG. 5.
Figure 8:
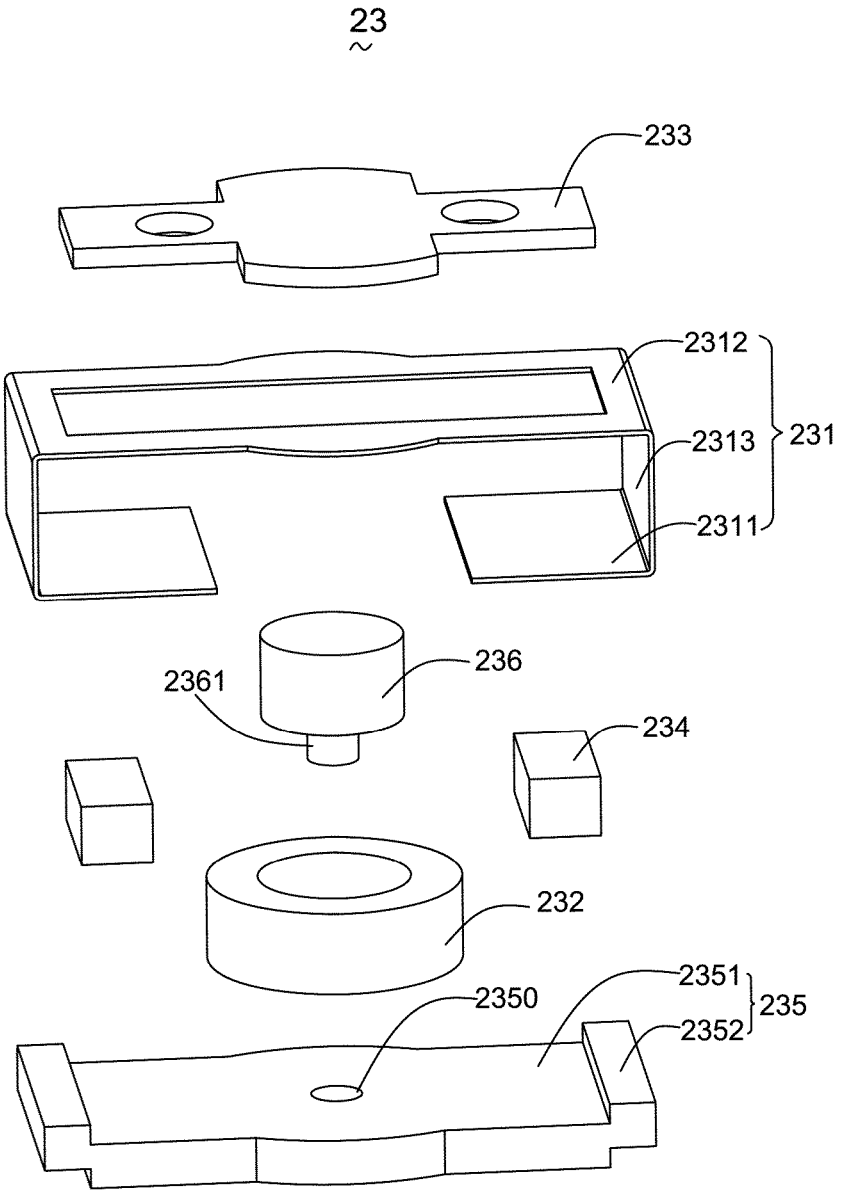
FIG. 8 is an exploded view of a vibrator of the screen speaker shown in FIG. 5.

Referring to FIG. 4, it shows several different frequency response curves corresponding to different input voltage. And the value of the frequency response becomes larger while the input voltage is increased, which means the sound generated by the screen is better.

In other embodiment, there may be one or two more vibrators 13, and the arrangement of the vibrators 13 is optional. The vibrator 13 could also be attached to the second screen 12 to actuate the second screen 12 to vibrate and generate sound.

Referring to FIGS. 5-8, a vibration speaker 200 according to a second embodiment of the present disclosure comprises a panel 21 with a first surface 211 exposing outside and a second surface 212 opposite to the first surface, a vibrator 23 disposed below the panel 21 and attached to the second surface 212 thereof, a cover 22 forming a receiving space to receiving the panel 21 and the vibrator 23, and an elastic member 25 assembled to the cover 22.

The cover 2 is provided with an upper cover 221 surrounding around the panel 21, and a lower cover 222 assembled with the upper cover 221. The elastic member 25 is disposed between the upper cover 221 and the lower cover 222 and made from rubber material. The elastic member 25 is provided with an inner end 251 attached to the second surface 212 of the panel 21, an outer end 252 disposed between the upper cover 221 and the lower cover 222, and a connecting part 253 disposed between the inner end 251 and the outer end 252. The connecting part 253 is concaved towards the lower cover 222 for improving the elasticity of the panel 21. The elastic member 25 is used for supporting the panel 21 and forming a sealed chamber 210 cooperating with the panel 21 and the cover 22.

The vibrator 23 is disposed on the lower cover 222 and received in the chamber 210. The vibrator 23 is an electromagnetic vibrator and provided with a vibrating unit and a magnetic circuit unit. The vibrating unit includes an elastic plate 231, and a weight 233 disposed on the elastic plate 231 and touching the second surface 212 of the panel 21. The magnetic circuit unit includes a yoke 235, a magnetic core 236 disposed on the yoke 235 and including a protruding portion 2361 passing through the yoke 235, a pair of magnets 234 disposed at two ends of the yoke 2352, a coil 232 surrounding the magnetic core 236 and disposed in a magnetic gap formed by the magnetic core 236 and the magnets 234.

The elastic plate 231 is made by pressing a flexible metallic plate and has a configuration of C-shape. The elastic plate 231 includes a vibrating plate 2312 supporting the weight 233, a pair of position plates 2311 disposed below and parallel to the vibrating plate 2312, two connecting plates 2313 respectively connecting two ends of the vibrating plate 2312 to the position plates 2311. The position plates 2311 are disposed under the yoke 235 and support the magnetic circuit unit.

The yoke 235 includes a base board 2351 for supporting the magnetic core 236, the coil 232 and the magnets 234, and a pair of position parts 2352 disposed at two ends of the base board 2351 for holding the magnets 234. The yoke 235 is partially enclosed by the elastic plate 231 with the base board 2351 supported by the position plates 2311 and the position portion 2352 enclosed by the connecting plates 2313. The base board 2351 is provided with a central hole 2350 for the protruding portion 2361 of the magnetic core 236 to pass through.

When the coil 232 is provided with signals, the vibrating plate 231 of the elastic plate 23 is actuated by the electromagnetic field generated by the magnetic circuit unit. The vibration of the vibrating plate 231 drives the weight 233 to vibrate, which drives the panel 21 to vibrate and generate sound.

In this embodiment, there are four vibrators 23 with a same vibration frequency and disposed on the lower cover 21. The four vibrators 23 form an arrangement of central symmetry. In other embodiment, the number and the arrangement of the vibrator 23 may be variable.

Apparently, the panel 11, 21 is serving as a diaphragm of the panel speaker 100, 200. The vibration speaker 11, 21 could generate both music and vibration and has a simple structure, which brings new choice for manufacturers and users. In fact, in actual applications, the panels described above are display screens, or components of display screens.

While the present invention has been described with reference to the specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A vibration speaker, comprising:

a display screen including a first surface and a second surface opposite to the first surface;

a vibrator disposed below the display screen with vibration direction perpendicular to the display screen;

a cover including a lower cover and an upper cover assembled with the lower cover for forming a receiving space to receive the display screen and the vibrator;

an elastic member comprising an inner end attached to the display screen, an outer end disposed between the lower cover and the upper cover, and a connecting part disposed between the inner end and the outer end for connecting the inner end to the outer end, the connecting part concaved towards the lower cover; wherein the display screen is actuated to vibrate and generate sound by the vibration of the vibrator.

2. The vibration speaker as described in claim 1 comprising two vibrators disposed at two sides of the display screen.

3. The vibration speaker as described in claim 2, wherein the vibrator is an electromagnetic vibrator including a vibrating unit and a magnetic circuit unit.

4. The vibration speaker as described in claim 3, wherein the vibrating unit includes an elastic plate and a weight disposed on the elastic plate, the magnetic circuit unit includes a yoke, a magnetic core disposed on the yoke and including a protruding portion passing through the yoke, a pair of magnets disposed at two ends of the yoke, a coil surrounding the magnetic core and disposed in a magnetic gap formed by the magnetic core and the magnets.

5. The vibration speaker as described in claim 4, wherein the elastic plate including a vibrating plate supporting the weight, a pair of position plates supporting the yoke, and a pair of connecting plates connecting the vibrating plate to the position plates.

6. The vibration speaker as described in claim 5, wherein the weight attaches to the second surface of the display screen.

7. The vibration speaker as described in claim 1 comprising four vibrators disposed under the display screen and forming an arrangement of central symmetry.

8. The vibration speaker as described in claim 1 further comprising a chamber for receiving the vibrator.

9. A vibration speaker, comprising:

a panel including a first surface disposed outside and a second surface opposite to the first surface;

at least two vibrators symmetrically attached to the second surface of the panel with the vibration direction perpendicular to the screen;

a cover including an upper cover, a lower cover assembled with the upper cover and together forming a receiving space to receive the panel and the vibrators;

an elastic member comprising an inner end attached to the display screen, an outer end disposed between the lower cover and the upper cover, and a connecting part disposed between the inner end and the outer end for connecting the inner end to the outer end, the connecting part concaved towards the lower cover; wherein the vibrators are supported by the lower cover and the panel is actuated to vibrate and generate sound by the vibration of the vibrators.

10. The vibration speaker as described in claim 9, wherein the vibrator is an electromagnetic vibrator including a vibrating unit and a magnetic circuit unit.

11. The vibration speaker as described in claim 10, wherein the vibrating unit includes an elastic plate and a weight disposed on the elastic plate, the magnetic circuit unit includes a yoke, a magnetic core disposed on the yoke and including a protruding portion passing through the yoke, a pair of magnets disposed at two ends of the yoke, a coil surrounding the magnetic core and disposed in a magnetic gap formed by the magnetic core and the magnets.

12. The vibration speaker as described in claim 11, wherein the elastic plate including a vibrating plate supporting the weight, a pair of position plates supporting the yoke, and a pair of connecting plates connecting the vibrating plate to the position plates.

13. The vibration speaker as described in claim 12, wherein the weight attaches to the second surface of the display screen.

14. The vibration speaker as described in claim 9 further comprising a chamber for receiving the vibrator.

* * * * *